US008517565B2

(12) United States Patent
Ohta

(10) Patent No.: US 8,517,565 B2
(45) Date of Patent: Aug. 27, 2013

(54) ILLUMINATION DEVICE

(75) Inventor: Kiyohisa Ohta, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 76 days.

(21) Appl. No.: 13/190,683

(22) Filed: Jul. 26, 2011

(65) Prior Publication Data

US 2012/0026735 A1 Feb. 2, 2012

(30) Foreign Application Priority Data

Jul. 27, 2010 (JP) ..... 2010-168187

(51) Int. Cl.
*F21V 7/00* (2006.01)

(52) U.S. Cl.
USPC ..... 362/235; 362/297; 362/298; 362/247; 362/551

(58) Field of Classification Search
USPC ..... 362/296, 551, 246, 297, 298, 247
See application file for complete search history.

(56) References Cited

U.S. PATENT DOCUMENTS

| | | | | |
|---|---|---|---|---|
| 5,608,290 | A | 3/1997 | Hutchisson et al. | |
| 6,598,998 | B2 * | 7/2003 | West et al. | 362/307 |
| 6,746,133 | B2 * | 6/2004 | Loga et al. | 362/147 |
| 7,798,675 | B2 * | 9/2010 | Chaves et al. | 362/281 |
| 8,246,212 | B2 * | 8/2012 | Schaefer et al. | 362/294 |
| 2008/0112156 | A1 | 5/2008 | Hsieh et al. | |

FOREIGN PATENT DOCUMENTS

| | | |
|---|---|---|
| CN | 2644869 Y | 9/2004 |
| JP | 3-81650 | 8/1991 |
| JP | 2000-269558 | 9/2000 |
| JP | 2004-343025 | 12/2004 |
| JP | 2006-99117 | 4/2006 |
| JP | 2009-009870 | 1/2009 |
| WO | WO 2009/149559 A1 | 12/2009 |

* cited by examiner

*Primary Examiner* — Ali Alavi
(74) *Attorney, Agent, or Firm* — Nixon & Vanderhye P.C.

(57) ABSTRACT

An LED light bulb includes a light source unit. The light source unit includes an LED light emitting element for emitting light and a reflecting plate on which a part of the light emitted from the LED light emitting element is incident. The reflecting plate changes a direction of the part of the light so that the direction of the part of the light is inclined from a direction of an optical axis of the light emitted from the LED light emitting element toward a plane vertical to the direction of the optical axis.

13 Claims, 5 Drawing Sheets

ILLUMINATION DEVICE

This Nonprovisional application claims priority under 35 U.S.C. §119(a) on Patent Application No. 2010-168187 filed in Japan on Jul. 27, 2010, the entire contents of which are hereby incorporated by reference.

1. Technical Field

The present invention relates to an illumination device employing an LED light emitting element as a light source.

2. Background Art

An LED light bulb is a light bulb in which an LED light emitting element serves as a light source. As compared with a conventional electric filament lamp, the LED light bulb has advantages of lower power consumption, a longer lifetime, and a shorter initial rise time period. For this reason, the use of the LED light bulb has rapidly grown in recent years.

However, light emitted from the LED light emitting element has strong directivity. For this reason, direct light emitted from the LED light emitting element mainly travels in a narrow range in a front direction, and only a small amount of direct light travels in a horizontal direction. This reduces visibility of light in the horizontal direction. An angle at which the LED light bulb emits light is thus limited to a narrow range in a front direction, and it is difficult for the LED light bulb to emit light in a wide range.

Each of Patent Literatures 1 through 5 discloses a technique for allowing an LED light bulb to emit light in a wider range.

CITATION LIST

Patent Literature

Patent Literature 1
Japanese Patent Application Publication, Tokukai, No. 2000-269558 A (Publication Date: Sep. 29, 2000)
Patent Literature 2
Japanese Patent Application Publication, Tokukai, No. 2004-343025 A (Publication Date: Dec. 2, 2004)
Patent Literature 3
Japanese Utility Model Application Publication, Jitsukaihei, No. 03-81650 U (1991) (Publication Date: Aug. 21, 1991)
Patent Literature 4
Japanese Patent Application Publication, Tokukai, No. 2006-99117 A (Publication Date: Apr. 13, 2006)
Patent Literature 5
Japanese Patent Application Publication, Tokukai, No. 2009-9870 A (Publication Date: Jan. 15, 2009)

SUMMARY OF INVENTION

Technical Problem

Patent Literature 1 discloses an illumination device in which (i) one or more LED light emitting elements are provided in a translucent cover and (ii) a concave section is formed at an end of the translucent cover so as to disperse light emitted from the one or more LED light emitting elements. According to Patent Literature 1, however, the translucent cover is made from a resin and therefore the concave section of the translucent cover has low light reflectivity. It is thus impossible to have a beneficial effect of efficiently guiding the light emitted from the LED light emitting element into the horizontal direction.

Each of Patent Literatures 2 and 3 discloses an LED light bulb in which a plurality of LED lamps are arranged in a specific three-dimensional pattern so that light is emitted from the LED light bulb three-dimensionally. However, as an individual light source, each of the plurality of LED lamps cannot provide sufficient light in a direction of a plane vertical to an optical axis of the light emitted from the LED light bulb. This causes the light emitted from each of the plurality of LED lamps to have non-uniformity in light intensity.

Meanwhile, each of Patent Literatures 4 and 5 discloses a technique employing an optical element. According to Patent Literature 4, a large part of a beam of light emitted from a light emitting element is guided, by an optical element, into a direction substantially vertical to a vertical axis of the optical element, and only a slight amount of light is emitted in a front direction. According to Patent Literature 5, a light source unit includes (i) a light source section serving as a light source, in which a plurality of semiconductor light emitting elements are arranged on a single surface, and (ii) an optical element having a circular cone shape. A bottom plane of the optical element serves as a light incident plane into which the light emitted from the plurality of semiconductor light emitting elements enters, The optical element concentrates the light incident on its bottom surface, and emits the light thus concentrated from its apex part which serves as a light exit plane. According to the technique disclosed in Patent Literature 5, the optical element has a circular cone shape, and the apex part of the circular cone shape serves as a point light source. With the arrangement, the light is emitted from the apex part in a radial pattern. However, light emitted toward an area lower than the apex part has less light intensity than that of light emitted toward an area higher than the apex part. That is, in a case where the light source unit disclosed in Patent Literature 5 is attached to a ceiling as an illumination device, the ceiling would not be sufficiently illuminated with light.

The present invention is made in view of the problems. An object of the present invention is to provide an illumination device employing a semiconductor light emitting element, which illumination device can emit light in a wide range while ensuring sufficiently-high light intensity both in a front direction and in a horizontal direction.

Solution to Problem

In order to attain the object, an illumination device of the present invention includes: at least one light source unit, the at least one light source unit including (i) a semiconductor light emitting element for emitting light and (ii) a light-traveling direction changing section on which a part of the light emitted from the semiconductor light emitting element is incident, the light-traveling direction changing section changing a direction of the part of the light so that the direction of the part of the light is inclined from a direction of an optical axis of the light emitted from the semiconductor light emitting element toward a plane vertical to the direction of the optical axis.

According to the arrangement, in the illumination device, the light emitted from the semiconductor light emitting element is divided into (i) the light incident on the light-traveling direction changing section, and (ii) the light that exits to the outside of the illumination device without being incident on the light-traveling direction changing section. The light incident on the light-traveling direction changing section is reflected from the light-traveling direction changing section, so that the direction of the light incident on the light-traveling direction changing section is inclined from the direction of the optical axis of the light emitted from the semiconductor light emitting element toward the plane that is vertical to the direction of the optical axis. On the other hand, the light that exits to the outside of the illumination device without being incident on the light-traveling direction changing section maintains the direction in which the semiconductor light emitting element emits the light. With the arrangement, it is possible to emit light in a wide range while ensuring sufficient light intensity both in a front direction and in a horizontal direction. Further, since it is possible to distribute light emitted from each semiconductor light emitting element both in the front direction and in the horizontal direction, it becomes possible to suppress directivity of the light emitted from the semiconductor light emitting element, and therefore suppress non-uniformity in light intensity.

Advantageous Effects of Invention

An illumination device of the present invention, includes: at least one light source unit, the at least one light source unit including (i) a semiconductor light emitting element for emitting light and (ii) a light-traveling direction changing section on which a part of the light emitted from the semiconductor light emitting element is incident, the light-traveling direction changing section changing a direction of the part of the light so that the direction of the part of the light is inclined from a direction of an optical axis of the light emitted from the semiconductor light emitting element toward a plane vertical to the direction of the optical axis. With the arrangement, it is possible to provide an illumination device which can emit light in a wide range while ensuring sufficient light intensity both in a front direction and in a horizontal direction.

Additional objects, features, and strengths of the pre sent invention will be made clear by the description below. Further, the advantages of the present invention will be evident from the following explanation in reference to the drawings.

DESCRIPTION OF EMBODIMENTS

Embodiments of the present invention will be described below with reference to FIGS. 1 through 6.

Embodiment 1

One embodiment of the present invention is described below with reference to FIGS. 1 through 3. Note that the number of members, and a shape of, a size of, and a material of each member, described in the present embodiment, are merely examples, and the present embodiment is not limited to these.

Figure 1:
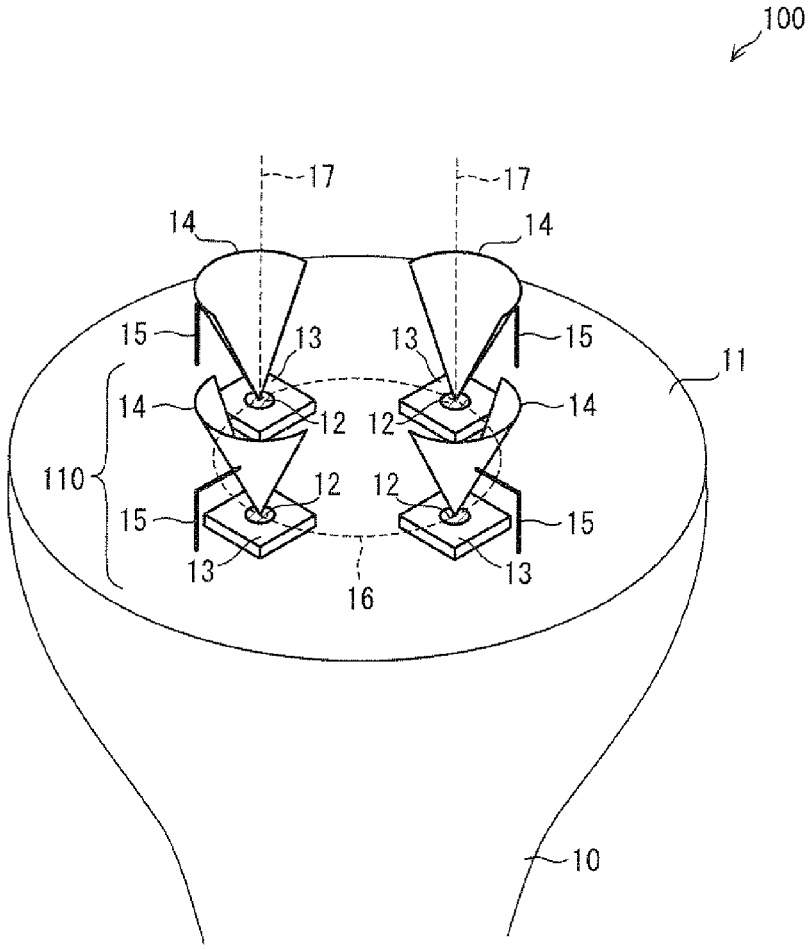
FIG. 1 is a side view schematically illustrating a configuration of an LED light bulb in accordance with one embodiment of the present invention.
Figure 2:
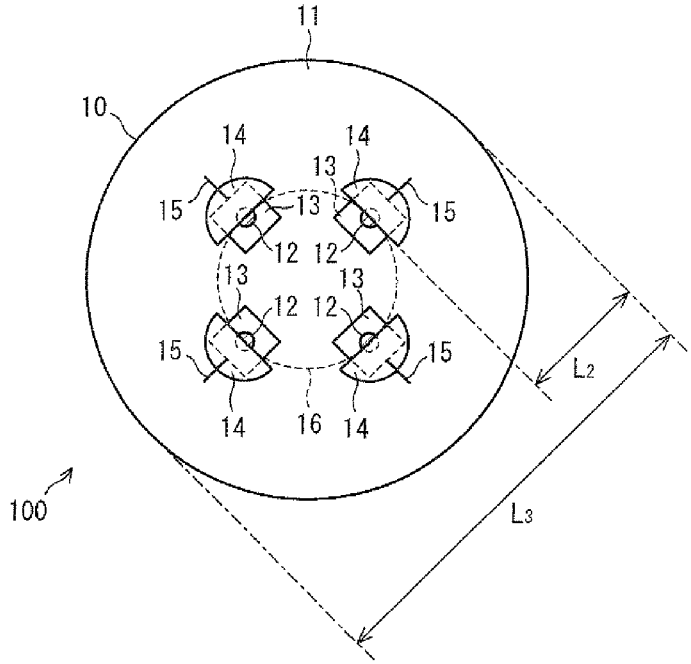
FIG. 2 is a top view schematically illustrating the configuration of the LED light bulb in accordance with the embodiment of the present invention

FIG. 1 is a side view schematically illustrating a configuration of an LED light bulb 100 (illumination device) in accordance with the present embodiment. FIG. 2 is a top view schematically illustrating the configuration of the LED light bulb 100 of the present embodiment. FIG. 3 is a cross-sectional view illustrating how a direction in which a part of light emitted from a light emitting element travels is changed by a reflecting plate of a light source unit 110 of the present embodiment.

The LED light bulb 100 includes an outer shell member 10, a substrate 11, and a light source unit 110. A diameter L3 of the substrate 11 is 60 mm. The LED light bulb 100 can include one or more light source units 110. According to the present embodiment, the LED light bulb 100 includes four light source units 110. The four light source units 110 are arranged on the substrate 11 so that centers 20 of the respective four light source units 110 are positioned on a circle 16 at equally-spaced intervals. For each of the four light source units 110, a minimum distance L2 from the center 20 to a periphery part of the substrate 11 is 18 mm.

Each of the four light source units 110 includes a light emitting section 12, an LED light emitting element 13 (semiconductor light emitting element), a reflecting plate 14 (light-traveling direction changing section), and a supporting member 15.

The LED light emitting element 13 is provided on the substrate 11. The light emitting section 12 is positioned at a center of the LED light emitting element 13. A diameter L1 of the light emitting section 12 is 4 mm (see FIG. 3). The reflecting plate 14 has a shape of a side wall of a half circular cone. The side wall of the half cone is a part of a surface of a circular cone whose central axis is an optical axis 17 of light emitted from the LED light emitting element 13. A height L4 of the half circular cone is not less than 10 mm. An angle 18 defined by the optical axis 17 and the reflecting plate 14 is in a range of 20° to 30°, which optical axis 17 serves as the central axis of the circular cone (see FIG. 3). An apex 19 of the side wall of the half circular cone is in contact with the center (substantial center) 20 of the LED light emitting element. It is preferable that the reflecting plate 14 is made from a metal, such as silver, nickel, or aluminum. The reflecting plate 14 made from such a metal can efficiently reflect light. Further, the reflecting plate 14 made from such a metal is excellent in heat resisting property, and is less likely to be deteriorated due to heat, as compared with a reflecting plate made from another material such as a resin.

It is more preferable that the reflecting plate 14 is made from silver. This is because the reflecting plate 14 made from silver is excellent in reflectivity. Further, it is more preferable that the reflecting plate 14 is such that a surface of a silver plate is coated with a silicone. It is more preferable to select, as the silicone with which the silver plate is coated, a silicone having low gas permeability, such as an organic modified silicone. In a case where the silver plate is coated with such a silicone, it is possible to prevent the silver plate from reacting with chemical substances in the vicinity of the silver plate, such as sulfur and bromine. That is, it is possible to prevent the silver plate from having a change in color. This prevents the reflecting plate 14 from having a reduction in reflectivity.

The supporting member 15 supports the reflecting plate 14 so that a predetermined positional relationship of the reflecting plate 14 is ensured.

Figure 3:
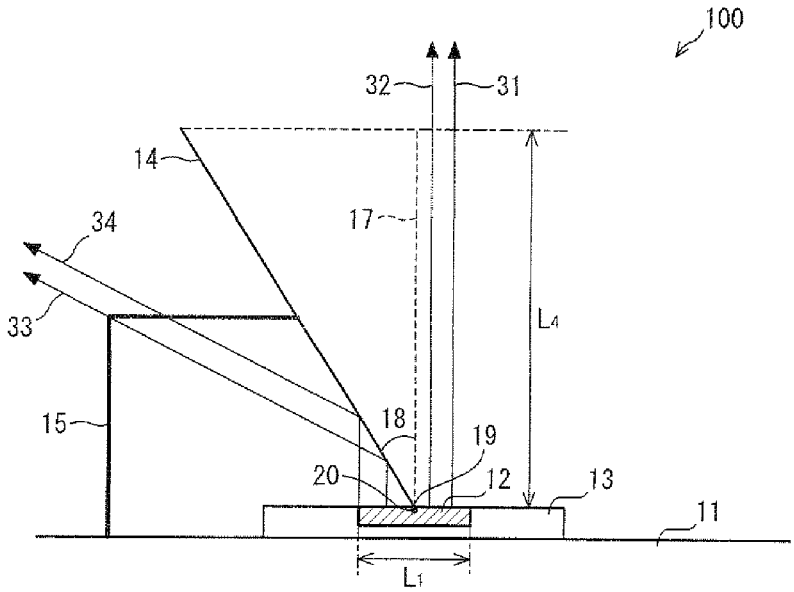
FIG. 3 is a cross-sectional view illustrating how a direction in which a part of light emitted from a light emitting element travels is changed by a reflecting plate of a light source unit in accordance with the embodiment of the present invention.

As illustrated in FIG. 3, light emitted from the light emitting section 12 of the LED light emitting element 13 is divided into (i) light (33, 34) (a part of emitted light) that is incident on the reflecting plate 14, and (ii) light (31, 32) (the other part of the emitted light) that exits to the outside of the LED light bulb 100 without being incident on the reflecting plate 14. The light (33, 34) incident on the reflecting plate 14 is reflected from the reflecting plate 14, so that the direction in which the light (33, 34) travels is inclined from a direction of an optical axis of the light emitted from the LED light emitting element 13 toward a plane vertical to the optical axis (i.e., the direction in which the light (33, 34) travels is inclined toward the horizontal direction, provided that the LED light bulb 100 is placed so that the optical axis of the light emitted from the LED light emitting element 13 extends in the vertical direction). On the other hand, the light (31, 32) that exits to the outside of the LED light bulb 100 without being incident on the reflecting plate 14 maintains the direction in which the light (31, 32) is emitted from the LED light emitting element 13.

As described above, with the arrangement, it is possible to distribute light emitted from the LED light emitting element 13 not only in a narrow range in a front direction but in a wide range.

Embodiment 2

Next, another embodiment of the present invention is described below with reference to FIGS. 4 and 5. Note that components having functions identical with those of the components described in Embodiment 1 have signs identical with those of the components described in Embodiment 1, and their explanations are omitted here for the sake of simple explanation. The present embodiment mainly deals with differences between an arrangement of the present embodiment and the arrangement of Embodiment 1. Further, the number of members, and a shape of, a size of, and a material of each member, described in the present embodiment, are merely examples, and the present embodiment is not limited to these.

Figure 4:
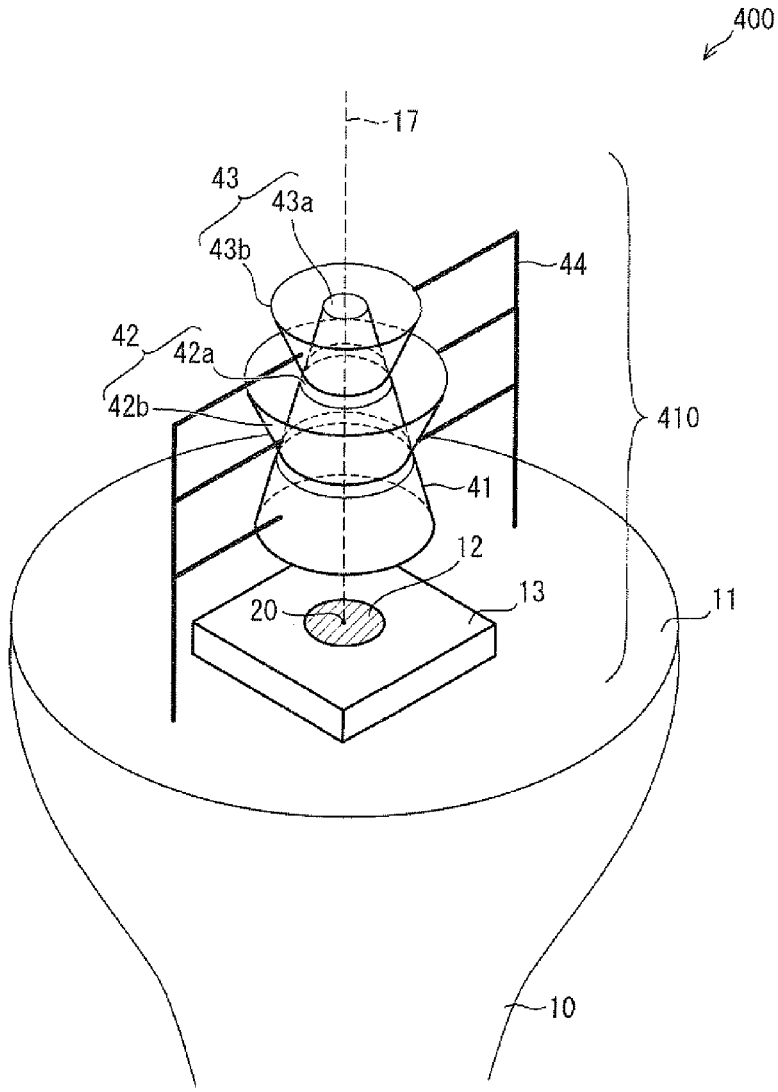
FIG. 4 is a side view schematically illustrating a configuration of an LED light bulb in accordance with another embodiment of the present invention.

FIG. 4 is a side view schematically illustrating a configuration of an LED light bulb 400 of the present embodiment. FIG. 5 is a cross-sectional view illustrating how a direction in which a part of light emitted from a light emitting element travels is changed by a reflecting plate of a light source unit 410 of the present embodiment.

The LED light bulb 400 includes an outer shell member 10, a substrate 11, and a light source unit 410. The light source unit 410 is provided at a center of the substrate 11.

The light source unit 410 includes a light emitting section 12, an LED light emitting element 13, three reflecting plates 41, 42, and 43, and a supporting member 44. The reflecting plate 42 includes a core section 42*a* and a guard section 42*b*, and the reflecting plate 43 includes a core section 43*a* and a guard section 43*b*. The reflecting plate 41, the core section 42*a* of the reflecting plate 42, and the core section 43*a* of the reflecting plate 43 constitute, in combination with each other, a circular cone shape whose central axis is an optical axis 17 of the LED light emitting element 13. The guard section 42*b* of the reflecting plate 42 becomes wider as it becomes farther from the LED light emitting element 13. The guard section 43*b* of the reflecting plate 43 also becomes wider as it becomes farther from the LED light emitting element 13. Both the reflecting plates 42 and 43 have such a hat shape that its brim is directed upward (see FIG. 5).

Figure 5:
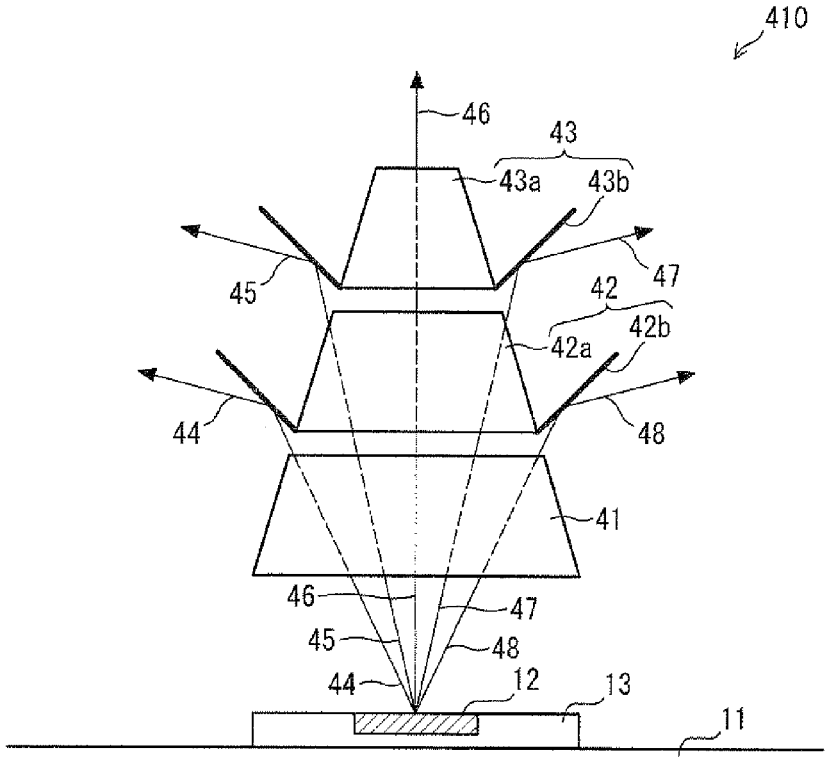
FIG. 5 is a cross-sectional view illustrating how a direction in which a part of light emitted from a light emitting element travels is changed by a reflecting plate of a light source unit in accordance with the another embodiment of the present invention.

The light emitting section 12 of the LED light emitting element 13 emits light (44, 45, 46, 47, 48) (see FIG. 5). The light emitted from the light emitting section 12 is divided into (i) light (44, 48) (a first part of emitted light) that is incident on the guard section 42*b* of the reflecting plate 42, (ii) light (45, 47) (a second part of emitted light) that is incident on the guard section 43*b* of the reflecting plate 43, and (iii) light (46) (a third part of emitted light) that exits to the outside of the LED light bulb 400 without being incident on any of the reflecting plates 41, 42, and 43. The light (44, 48) incident on the guard section 42*b* of the reflecting plate 42 is reflected from the reflecting plate 42, so that the direction in which the light (44, 48) travels is inclined from a direction of an optical axis of the light emitted from the LED light emitting element 13 toward a plane vertical to the optical axis (i.e., the direction in which the light (44, 48) travels is inclined toward the horizontal direction, provided that the LED light bulb 400 is placed so that the optical axis of the light emitted from the LED light emitting element 13 extends in the vertical direction). Further, the light (45, 47) incident on the guard section 43*b* of the reflecting plate 43 is reflected from the reflecting plate 43, so that the direction in which the light (45, 47) travels is inclined from the direction of the optical axis of the light emitted from the LED light emitting element 13 toward a plane vertical to the optical axis (i.e., the direction in which the light (45, 47) travels is inclined toward the horizontal direction, provided that the LED light bulb 400 is placed so that the optical axis of the light emitted from the LED light emitting element 13 extends in the vertical direction). On the other hand, the light (46) that exits to the outside of the LED light bulb 400 without being incident on any of the reflecting plates 41, 42, and 43, maintains the direction in which the light (46) is emitted from the LED light emitting element 13.

As described above, with the arrangement, it is possible to distribute light emitted from the LED light emitting element 13 not only in a narrow range in a front direction but in a wide range.

Embodiment 3

Next, further another embodiment of the present invention is described below with reference to FIG. 6. Note that components having functions identical with those of the components described in Embodiment 1 have signs identical with those of the components described in Embodiment 1, and their explanations are omitted here, for the sake of simple explanation. The present embodiment mainly deals with differences between an arrangement of the present embodiment and the arrangement of Embodiment 1. Further, the number of members, and a shape of, a size of, and a material of each member, described in the present embodiment, are merely examples, and the present embodiment is not limited to these.

Figure 6:
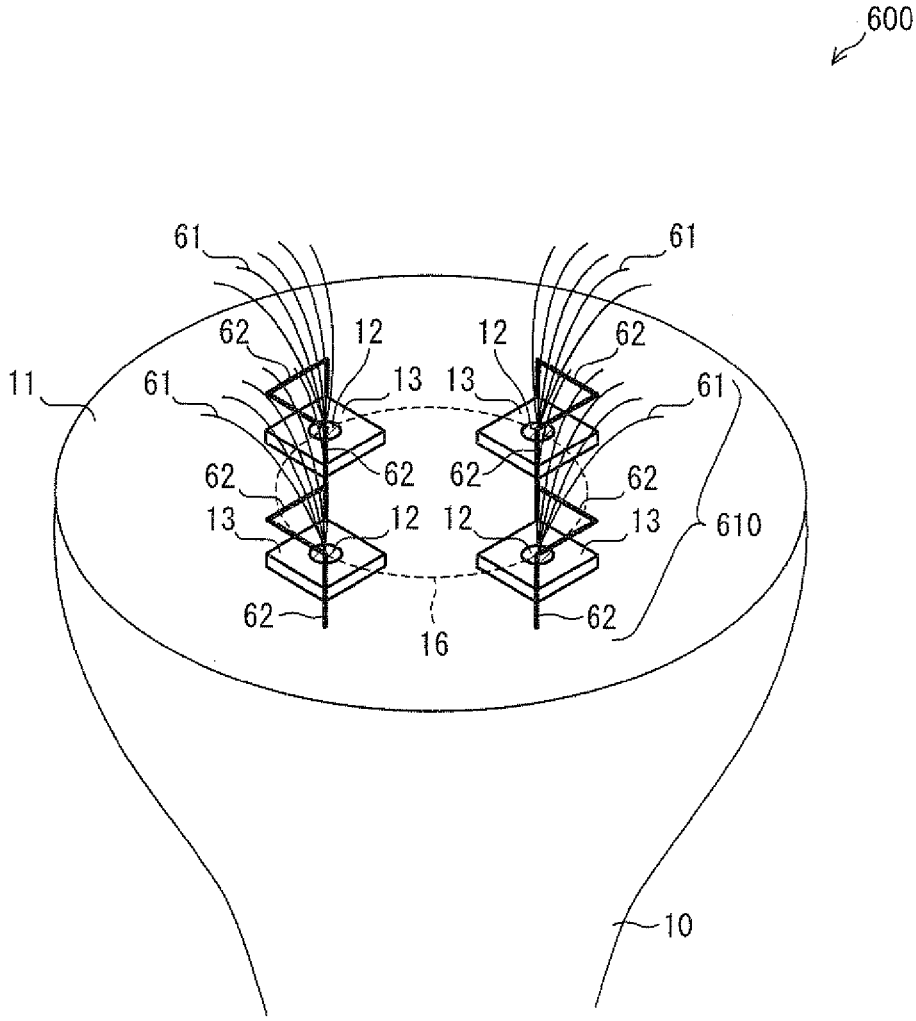
FIG. 6 is a side view schematically illustrating a configuration of an LED light bulb in accordance with further another embodiment of the present invention.

FIG. 6 is a side view schematically illustrating a configuration of an LED light bulb 600 in accordance with the present embodiment.

The LED light bulb 600 includes an outer shell member 10, a substrate 11, and a light source unit 610. The LED light bulb 600 can include one or more light source units 610. According to the present embodiment, the LED light bulb 600 includes four light source units 610. The four light source units 610 are arranged on the substrate 11 so that centers 20 of the respective four light source units 610 are positioned on a circle 16 at equally-spaced intervals.

Each of the four light source units 610 includes a light emitting section 12, an LED light emitting element 13, an optical fiber 61, and a supporting member 62. The optical fiber 61 is provided so that one of ends of the optical fiber 61, into which light enters, is positioned in the vicinity of the light emitting section 12, while the other one of ends is arranged to extend in a direction that is inclined from a vertical direction toward a horizontal direction.

The light emitted from the light emitting section 12 of the LED light emitting element 13 is divided into (i) light that enters into the optical fiber 61 and (ii) light that exits to the outside of the LED light bulb 600 without entering into the optical fiber 61. A direction of the light entering into the optical fiber 61 is changed as the light travels through the optical fiber 61, so that the direction of the light is inclined from a direction of an optical axis of the light emitted from the LED light emitting element 13 toward a plane vertical to the optical axis (i.e., the direction of the light entering into the optical fiber 61 is inclined toward the horizontal direction, provided that the LED light bulb 600 is placed so that the optical axis of the light emitted from the LED light emitting element 13 extends in the vertical direction). On the other hand, the light that exits to the outside of the LED light bulb 600 without entering into the optical fiber 61 maintains the direction in which the light is emitted from the LED light emitting element 13.

As described above, with the arrangement, it is possible to distribute light emitted from the LED light emitting element 13 not only in a narrow range in a front direction but in a wide range.

Additional Matters

The illumination device of the present invention is preferably arranged such that the light-traveling direction changing section is a reflecting plate which reflects the part of the light.

According to the arrangement, it is possible to cause the reflecting plate to efficiently reflect light.

Further, as compared with an optical element made from glass, the illumination device employing the reflecting plate can be lighter in weight and lower in production cost.

In order to attain the object, the illumination device of the present invention may be arranged such that the reflecting plate has a shape of a side wall of a half circular cone.

According to the arrangement, the reflecting plate has the shape of the side wall of the half circular cone. This allows the reflecting plate to efficiently reflect the light.

In order to attain the object, the illumination device of the present invention may be arranged such that the reflecting plate has a shape of a side wall of a half circular cone, the side wall of the half circular cone is a part of a side wall of a circular cone whose central axis is the optical axis of the semiconductor light emitting element, and an apex of the half circular cone is positioned in the vicinity of a center of the semiconductor light emitting element.

According to the arrangement, the reflecting plate has a shape of the side wall of the half circular cone, and the apex of the half circular cone is positioned in the vicinity of the center of the semiconductor light emitting element. The half circular cone is a part of the circular cone whose central axis is the optical axis of the semiconductor light emitting element. With the arrangement, the light emitted from the semiconductor light emitting element is divided into (i) light (substantially half of the light emitted from the semiconductor light emitting element) that is incident on the reflecting plate, and (ii) light (the other half of the light) that is not incident on the reflecting plate. The light that is not incident on the reflecting plate maintains the direction in which the light is emitted from the semiconductor light emitting element. On the other hand, the light that is incident on the reflecting plate is reflected from the reflecting plate, so that the direction of the light incident on the reflecting plate is inclined from the direction of the optical axis toward the horizontal direction which is vertical to the direction of the optical axis. With the arrangement, the light emitted from the semiconductor light emitting element is distributed both in a front direction and in a horizontal direction, and the light traveling in the front direction and the light guided into the horizontal direction become substantially equal to each other in light amount. It is thus possible to distribute light in a wide range.

In order to attain the object, the illumination device of the present invention may be arranged such that the at least one light source unit includes a plurality of light source units, and the plurality of light source units are provided on a circle at equally-spaced intervals on a substrate.

According to the arrangement, the illumination device includes a plurality of light source units. The illumination device has therefore higher luminance intensity than that of an illumination device including a single light source unit. The plurality of light source units are arranged on the circle at equally-spaced intervals on the substrate. This allows the illumination device to emit light in a wide range without locally generating non-uniformity in light intensity.

In order to attain the object, the illumination device of the present invention may be arranged such that the reflecting plate is made from a metal.

With the arrangement, it is possible for the reflecting plate to reflect the light more efficiently. Further, the reflecting plate made from a metal has a high heat resisting property. For this reason, the reflecting plate made from a metal is less likely to be deteriorated due to heat or the like, as compared with a reflecting plate made from another material such as a resin.

In order to attain the object, the illumination device of the present invention may be arranged such that the metal is silver.

According to the arrangement, it is possible to cause a reflecting plate to have high reflectivity.

In order to attain the object, the illumination device of the present invention may be arranged such that a surface of the reflecting plate made from silver is coated with a silicone.

According to the arrangement, it is possible to prevent the reflecting plate made from silver from reacting with chemical substances existing in the vicinity of the reflecting plate. That is, it is possible to prevent the reflecting plate from having a change in color. It is therefore possible to prevent the reflecting plate from having a reduction in reflectivity.

In order to attain the object, the illumination device of the present invention may be arranged such that the light-traveling direction changing section is an optical fiber.

According to the arrangement, in the illumination device, a part of the light emitted from the semiconductor light emitting element enters into the optical fiber and guided by the optical fiber so that the direction of the part of the light is inclined from the direction of the optical axis toward the horizontal direction. This allows the illumination device to ensure sufficiently-high light intensity not only in a narrow range in the front direction but also in the horizontal direction. It is therefore possible for the illumination device to emit light in a wide range.

INDUSTRIAL APPLICABILITY

The present invention is suitably applicable to, for example, an illumination device employing a semiconductor light emitting element, such as an LED light bulb.

REFERENCE SIGNS LIST

10: Outer shell member
11: Substrate
12: Light emitting section
13: LED light emitting element (semiconductor light emitting element)

14: Reflecting plate (light-traveling direction changing section)
15: Supporting member
16: Circle
17: Optical axis
18: Angle
19: Apex
20: Center
31, 32, 33, 34: Light
41, 42, 43: Reflecting plate (light-traveling direction changing section)
44: Supporting member
45, 46, 47, 48, 49: Light
61: Optical fiber (light-traveling direction changing section)
62: Supporting member
100: LED light bulb (illumination device)
110: Light source unit
400: LED light bulb (illumination device)
410: Light source unit
600: LED light bulb (illumination device)
610: Light source unit

The invention claimed is:

1. An illumination device comprising:
at least one light source unit,
the at least one light source unit including (i) a semiconductor light emitting element for emitting light and (ii) a light-traveling direction changing section on which a part of the light emitted from the semiconductor light emitting element is incident,
the light-traveling direction changing section changing a direction of the part of the light so that the direction of the part of the light is inclined from a direction of an optical axis of the light emitted from the semiconductor light emitting element toward a plane vertical to the direction of the optical axis, wherein:
the light-traveling direction changing section is an optical fiber.

2. An illumination device comprising:
at least one light source unit,
the at least one light source unit including (i) a semiconductor light emitting element for emitting light and (ii) a light-traveling direction changing section on which a part of the light emitted from the semiconductor light emitting element is incident,
the light-traveling direction changing section changing a direction of the part of the light so that the direction of the part of the light is inclined from a direction of an optical axis of the light emitted from the semiconductor light emitting element toward a plane vertical to the direction of the optical axis, wherein:
the light-traveling direction changing section is a reflecting plate which reflects the part of the light.

3. The illumination device as set forth in claim 2, wherein:
the reflecting plate has a shape of a side wall of a half circular cone.

4. The illumination device as set forth in claim 3, wherein:
the at least one light source unit is provided on a substrate;
the side wall of the half circular cone is a part of a side wall of a circular cone whose central axis is the optical axis of the semiconductor light emitting element; and
an apex of the half circular cone is positioned in the vicinity of a center of the semiconductor light emitting element.

5. The illumination device as set forth in claim 2, wherein:
the reflecting plate is made from a metal.

6. The illumination device as set forth in claim 5, wherein:
the metal is silver.

7. The illumination device as set forth in claim 6, wherein:
a surface of the reflecting plate made from silver is coated with a silicone.

8. The illumination device as set forth in claim 2, wherein:
the at least one light source unit includes a plurality of light source units; and
the plurality of light source units are provided on a circle at equally-spaced intervals on a substrate.

9. An illumination device comprising:
at least one light source unit including a semiconductor light emitting element for emitting light; and
a light-traveling direction changing section on which a part of the light emitted from the semiconductor light emitting element is incident, including a plurality of reflecting plates each reflecting the incident light.

10. The illumination device as set forth in claim 9, wherein:
the plurality of reflecting plates include a first reflecting plate and a second reflecting plate; and
the first reflecting plate is provided in an upper position with respect to the second reflecting plate.

11. The illumination device as set forth in claim 9, wherein:
at least one of the plurality of reflecting plates includes a guard section.

12. The illumination device as set forth in claim 11, wherein:
said at least one of the plurality of reflecting plates further includes a core section.

13. An LED light bulb comprising:
an LED light emitting element;
a first reflecting projection for reflecting an incident light emitted from said LED light emitting element; and
a second reflecting projection for reflecting an incident light emitted from said LED light emitting element, the distance between said second reflecting projection and said LED light emitting element being smaller than the distance between said first reflecting projection and said LED light emitting element.

* * * * *